US006889446B2

(12) United States Patent
Schneider

(10) Patent No.: US 6,889,446 B2
(45) Date of Patent: May 10, 2005

(54) DRIER FOR OBJECTS, PARTICULARLY FOR VEHICLE BODIES, AND METHOD FOR OPERATING SUCH A DRIER

(75) Inventor: Heiko Schneider, Kirchentellinsfurt (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 10/663,430

(22) Filed: Sep. 16, 2003

(65) Prior Publication Data

US 2004/0123491 A1 Jul. 1, 2004

(30) Foreign Application Priority Data

Sep. 16, 2002 (DE) ..... 102 42 944

(51) Int. Cl.[7] ..... F26B 3/30
(52) U.S. Cl. ..... 34/270; 34/666; 432/21
(58) Field of Search ..... 34/270, 666; 432/21

(56) References Cited

U.S. PATENT DOCUMENTS 5,594,999 A * 1/1997 Best ..... 34/270
5,868,562 A * 2/1999 Watanabe et al. ..... 432/21

FOREIGN PATENT DOCUMENTS

DE 43 12 892 A1 10/1994

OTHER PUBLICATIONS

Article by GOCH GMBH & Co. entitled Catalytic Radiator, 5 pages, dated Apr. 2002, published in Germany.

* cited by examiner

*Primary Examiner*—Stephen Gravini
(74) *Attorney, Agent, or Firm*—Factor & Lake

(57) ABSTRACT

A drier for objects, particularly for vehicle bodies, comprises, in a per se known manner, a housing in which is formed a drying chamber which accommodates the objects. In the said drying chamber, the objects are subjected to an IR radiation generated by at least one catalytic radiator. The drier can be used as a device for purifying air which contains pollutants, in that the intake air supplied to the drying chamber is routed exclusively via the catalytically active layer of the catalytic radiator, so that the organic impurities contained in the intake air can be catalytically oxidized there in a controlled manner. In this case, the catalytic radiator must be of heat-resistant design, such that it does not require air cooling. Both unpurified air, originating from another location, and the air containing organic impurities which is produced in the drier itself can be purified in the drier.

10 Claims, 3 Drawing Sheets

DRIER FOR OBJECTS, PARTICULARLY FOR VEHICLE BODIES, AND METHOD FOR OPERATING SUCH A DRIER

BACKGROUND OF INVENTION

The invention relates to a drier for objects, particularly for vehicle bodies, comprising a) a housing, in which is formed a drying chamber which accommodates the objects;

b) a connection for intake air;

c) a connection for exhaust air;

d) at least one catalytic radiator which, in turn, comprises:

da) at least one connection for combustion gas;

db) a catalytically active layer to which the combustion gas is supplied;

dc) at least one connection for combustion air, connected to the catalytically active layer via an air duct;

and to a method for operating a drier for objects, particularly vehicle bodies, in which a) the objects to be dried are brought into a drying chamber in the housing of the drier;

b) in the drying chamber, the objects to be dried are exposed to an infrared radiation generated by a catalytic radiator to whose catalytically active layer combustion gas and combustion air are supplied;

c) intake air is continuously supplied to, and exhaust air continuously extracted from, the drying chamber.

Driers which operate with catalytic radiators as a heat source are becoming increasingly popular. There is a good reason for this: firstly, the primary energy used, namely, the combustion gas (natural gas, propane, butane or liquid gas) is very inexpensive compared with electrical energy. Secondly, with such catalytic radiators, it is possible to generate an infrared radiation in that long-wave range which is particularly effective for drying or firing coatings, particularly paint coatings. Energy savings are also achieved in that, substantially, only the coating to be dried is heated, but not other objects.

In addition, the long-wave radiation of a catalytic radiator has the characteristic of gently heating and drying the object with an energy density which is moderate compared with short-wave or medium-wave radiation.

It has already been previously recognized that organic impurities, contained in the combustion air supplied to the catalytic radiator, are catalytically oxidized in the catalytically active layer of catalytic radiators. Hitherto, however, this fact has only been considered as a fortunate side effect of the use of catalytic radiators, and has not been purposefully used. In the case of the known driers of the initially stated type, this was also not possible, because these catalytic radiators used, which needed an air cooling, or the air duct was not defined inside the drier. In those cases, there was thus brought into the drying chamber intake air which was not constrained to flow over the catalytically active layer. Impurities contained in this intake air thus remained unoxidized, with the result that the exhaust air extracted from the drier had to be supplied to a separate exhaust-air purification appliance, for example, a thermal, regenerative or even a catalytic post-combustion appliance. These appliances then frequently served as a general disposal system for all exhaust-air volume flows loaded with organic substances, particularly solvents, that occurred in the installation as a whole, i.e., not only in the drier. In the case of painting installations, these typically come from, in particular, the spraying booth, the flashing-off zone, the drier, the paint mixing room or from other sources.

The additional exhaust-gas purification appliances that are thus necessary in the case of the known driers of the initially stated type obviously give rise to relatively high costs.

An object of the present invention is to design a drier of the initially stated type in such a way that it is possible to dispense with a separate exhaust-gas purification appliance or the quantities of exhaust air produced are at least reduced, so that the separate exhaust-gas purification appliance can be kept smaller, and therefore less expensive.

This object is achieved, according to the invention, in that e) the connection of the drier for intake air is connected exclusively to the connection of the catalytic radiator for combustion air, in such a way that, apart from unavoidable leakages of the housing, all the intake air is routed as combustion air via the catalytic radiator;

f) the catalytic radiator is of heat resistant design, such that it does not require air cooling.

The concept according to the invention is as follows: if catalytic radiators are used which do not require air cooling, all the intake air brought into the drying chamber of the drier can be directed in a constrained manner via the connection of the catalytic radiator for combustion air, so that all intake air passing into the drying chamber has flowed at least once past the catalytically active layer or through the catalytically active layer. In this way, it becomes possible for the catalytic oxidative transformation of the organic impurities in the intake air to be performed as a controlled reaction, quantitative predictions of the reaction conversion also being possible.

In favourable cases, a single passage of the intake air through the catalytically active layer of a catalytic radiator is sufficient to effect adequate purification.

The intake air supplied to the drier in this case can originate partly from the drier itself, but also from other parts of an installation, so that the drier, as a "general disposal facility" for the entire installation, can fully or partially replace the separate exhaust-air purification appliances previously provided for this purpose.

The catalytic radiator can have a connection via which exclusively intake air is supplied to it. This intake air is directed within the catalytic radiator to a location from which it can flow against a surface of the catalytically active layer in a defined manner. As a result, conditions are created in which there occurs a controlled transformation of the organic impurity contained in the intake air.

An even greater efficiency is achieved in the case of that embodiment of the invention in which the catalytic radiator has a connection which is connected to a premixer in which combustion gas and intake air are mixed together. This mixing of combustion gas and intake air containing pollutants, which occurs even before they enter the catalytic radiator, promotes the catalytically activated oxidation of the organic impurities, so that a greater degree of transformation is achieved.

A blower, by means of which the air in the drying chamber can be circulated, can be provided for the purpose of convective heating of the objects to be dried.

In those cases in which adequate purification is not yet achieved with a single passage of the intake air through the catalytically active layer of a catalytic radiator, it is possible to use an embodiment of the invention in which the drier is of a multi-stage design, each stage being designed in the manner described in one of claims 1 to 4, and the exhaust-air connection of the respectively upstream stage being connected to the intake-air connection of the respectively downstream stage. In this way, in passing through the drier, the intake air supplied to the drier passes several times through a catalytically active layer of a catalytic radiator, with the result that the transformation of the organic impurities is effected in a more complete manner. In principle, any number of such stages can be provided, until the required degree of purification is achieved.

A further object of the present invention is to disclose a method for operating a drier of the initially stated type, in which the catalytic radiators contained in the drier can be used in a purposeful and controllable manner for purifying the intake air supplied to the drier.

This object is achieved, according to the invention, in that d) all the intake air supplied to the drying chamber, apart from unavoidable leakages of the housing of the drier, is routed as combustion air via the catalytically active layer of the catalytic radiator;

e) a catalytic radiator is used which is of heat resistant design, such that it does not require cooling.

The advantages of this method according to the invention correspond analogously to the above-mentioned advantages of the drier according to the invention.

Advantageous developments of the method according to the invention are disclosed in claims 6 to 10. The advantages that can be achieved with them also correspond to the above-mentioned advantages of particular embodiments of the drier.

BRIEF DESCRIPTION OF THE DRAWINGS

Exemplary embodiments of the invention are explained more fully in the following with reference to the drawing, wherein.

DETAILED DESCRIPTION OF THE DRAWINGS

Figure 1:
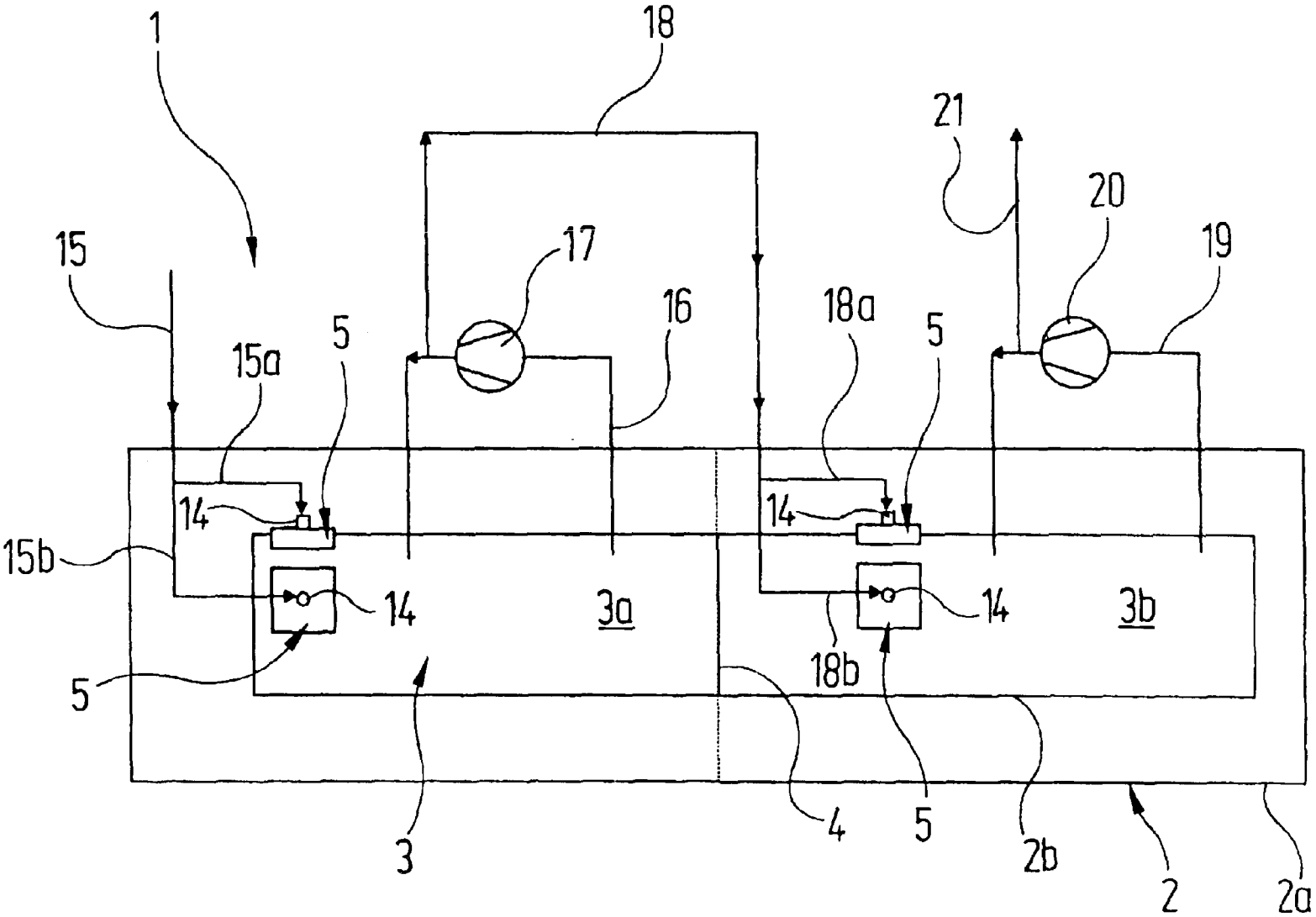
FIG. 1: shows, in schematic form, a two-stage drier for use in a painting installation for vehicle bodies.

Reference is made firstly to FIG. 1. The drier, denoted in general by the reference 1, comprises a housing 2 with an outer wall 2*a* and an inner wall 2*b*. The inner wall 2*b* of the housing 2 encloses a drying chamber 3 which is divided by a device 4, e.g. a division wall, into two sub-chambers 3*a* and 3*b* which are separate from one another in respect of their air system. Newly painted vehicle bodies are brought, through hatches not represented in the drawing, coming from the left, by means of a conveyor system which is likewise not represented, into the sub-chamber 3*a*, transferred from the latter, through a hatch provided in the device 4, into the sub-chamber 3*b*, and leave the housing 2 of the drier 1 through a further hatch not represented in the drawing.

A plurality of catalytic radiators 5 are set into the inner wall 2*b* of the housing 2, preferably both in its side walls and in the ceiling wall, in such a way that their radiating surfaces are directed towards the sub-chambers 3*a* and 3*b* of the drying chamber 3. The design of these catalytic radiators 5 is indicated by the schematic FIG. 2. As shown by this figure, each catalytic radiator 5 comprises an outer housing 6 and an inner housing 7, between which remains a flow-through gap 8 which serves as an air duct. The outer housing 6 and the inner housing 7 are open at the side which, in FIG. 2, is the lower side, facing towards the drying chamber 3 in operation.

Figure 2:
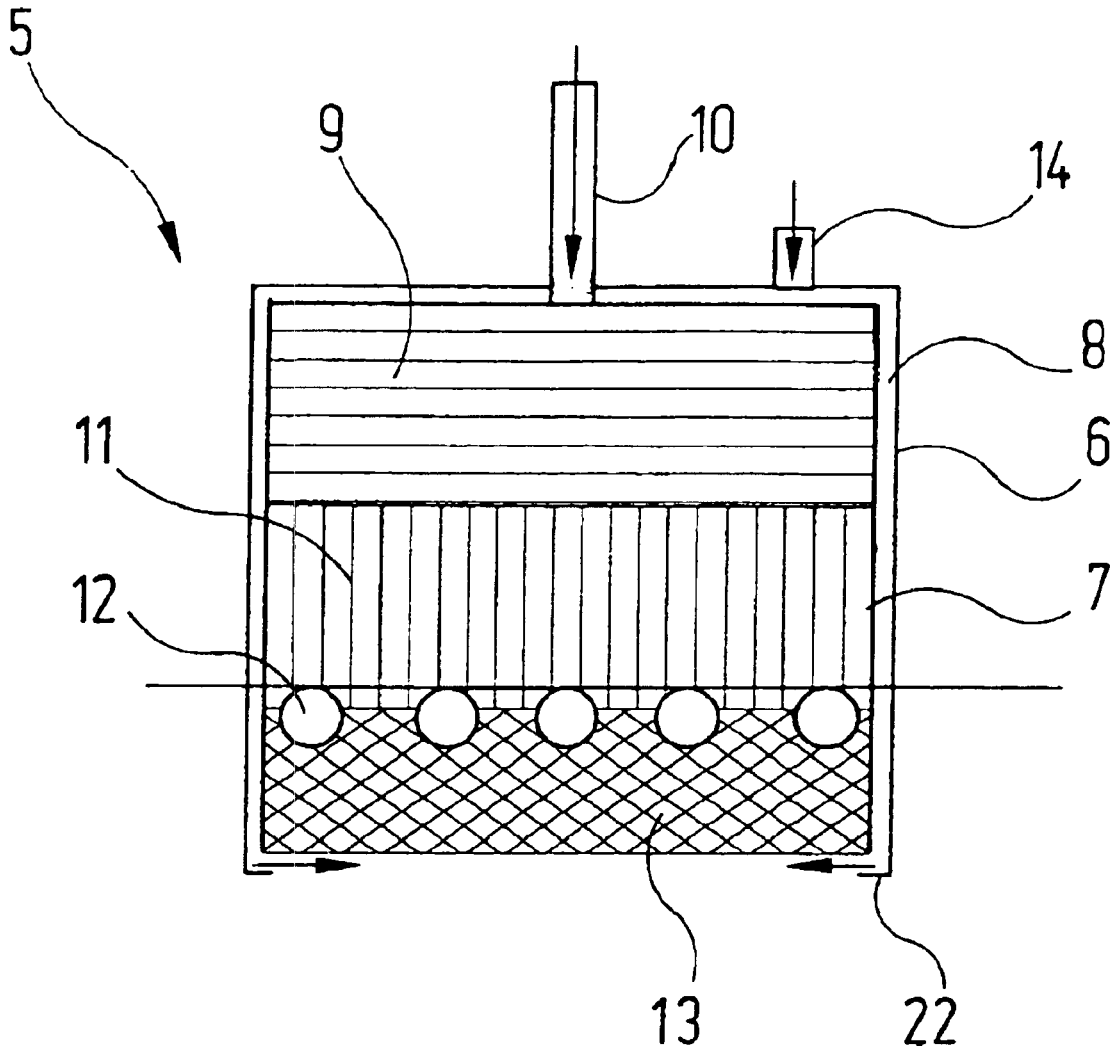
FIG. 2: shows a schematic section of a catalytic radiator as used in the drier according to FIG. 1.

The inner housing 7 of the catalytic radiator 5 includes, from the top downwards, a gas distribution device 9 into which there opens a gas supply line 10, an insulation layer 11, an electrical preheating system 12 and a catalytically active layer 13, which is open on the side which faces downwards in FIG. 2.

An air supply nozzle 14 opens into the flow-through gap 8 between the outer housing 6 and the inner housing 7.

Through the choice of materials used, the entire catalytic radiator 5 is designed to be resistant to high temperature, and thus does not require cooling air, even at operating temperatures of, for example, 250 to 300° C.

As shown by FIG. 1, intake air is supplied, via a line 15 and branch lines 15*a*, 15*b*, which are connected to the corresponding air supply nozzles 14 of the catalytic radiators 5, to the catalytic radiators 5 disposed in the sub-chamber 3*a* of the drying chamber 3. This intake air can be, for example, solvent-laden exhaust air from a flashing-off zone assigned to the drier 1 or slightly odorous exhaust air from a cathodic dip-painting installation.

The air contained in the sub-chamber 3*a* of the drying chamber 3 can be circulated via a line 16 in which is located a blower 17. Branching off from the line 16 is a further line 18, which leads to the air supply nozzles 14 of the catalytic radiators 5 disposed in the second sub-chamber 3*b* of the drying chamber 3. A circulation line 19, in which a further blower 20 is located, is also assigned to the sub-chamber 3*b*. An exhaust-air line 21 leads from the circulation line 19 to the outside atmosphere.

The drier 1 described above operates as follows:

At the start of operation, the catalytically active layers 13 of the various catalytic radiators 5 are preheated, by means of the electrical preheating systems 12, to a temperature of ca. 150 to 200° C., necessary for the catalytic oxidation of the combustion gas. Combustion gas is then supplied to the catalytic radiators 5 in both sub-chambers 3*a*, 3*b* of the drying chamber 3, via the respective gas supply lines 10. This combustion gas is distributed evenly over the entire flow cross-section in the corresponding catalytic radiator 5 by the gas distribution device 9, permeates the insulation layer 11 which, due to its flow resistance, also contributes to the even distribution of the gas flow, and then passes into the preheated catalytically active layer 13.

At the outer surface of the latter, which faces downwards in FIG. 2, the intake air, which has flowed via the respective air supply nozzles 14 and the flow-through gap 8 and which, due to the inwardly bent edge flange 22 of the outer housing 6, has assumed a main flow direction which is parallel to the surface of the catalytically active layer 13, meets the combustion gas. The catalytic reaction then occurs with the planar outflow of combustion gas, the catalytically active layer being heated to an operating temperature of about 600° C. The hot outer surface of the catalytically active layer 13 now emits infrared radiation in the long-wave range. Following attainment of the operating temperature, the electrical preheating system 12 is switched off.

In detail, the air paths in the drier 1 represented in FIG. 1 are as follows:

In the catalytic radiators 5 assigned to the sub-chamber 3*a* on the left in FIG. 1, the air supplied via the line 15, for example, originating from the flashing-off zone and loaded with organic substances, comes into contact with the combustion gases and reacts catalytically with them. A portion of the organic impurities supplied with this air is also oxidized at the same time. The air in the sub-chamber 3*a* is circulated by means of the blower 17 and, via the line 18, an air flow is extracted which—converted to the same temperature—corresponds to the quantity of air supplied via the line 15.

The air circulated by the blower also flows over the object to be dried, heating it by convection. The quantity of circulated air determines, in addition to its temperature, the quantity of energy transmitted.

The catalytic radiators 5 transmit energy, in the form of infrared radiation, to the object to be dried. This quantity of energy is determined by, amongst other things, the quantity of combustion gas supplied by the lines 10, and by the distance between the object to be dried and the catalytic radiators 5.

The ratio in which heat is supplied by radiation and by convection can be varied, according to the object to be dried, by varying the quantity of circulating air, by adjusting the output of the catalytic radiators 5, and through the distance between the object to be dried and the catalytic radiators 5. Two limiting cases are conceivable in this connection: in the case of a very small distance between the object and the catalytic radiators, and a very small quantity of circulating air with a low temperature, the proportion of heat transmission effected through radiation approaches 100%. In the case of a very large distance between the object and the catalytic radiators 5 and a low output of the catalytic radiators 5, and with a large quantity of circulating air and a high circulating-air temperature, the proportion of convective heat transmission approaches 100%.

The air, relieved thus to a certain extent of organic substances, is supplied, via the line 18, to the catalytic radiators 5 assigned to the sub-chamber 3*b*, on the right in FIG. 1, of the drying chamber 3. There, a reaction of the entrained organic impurities occurs, in a similar manner, at the catalytic layers 13. The result is that the air, circulated by means of the blower 20 and via the line 19, is to a large extent relieved of organic substances in the sub-chamber 3*b* of the drying chamber, so that the air extracted via the line 21 can be discharged into the outside atmosphere.

It is obviously possible for the number of purification stages, each comprising mutually separate air chambers and circulation devices, to be increased if necessary in order to achieve a greater degree of air purification.

Figure 3:
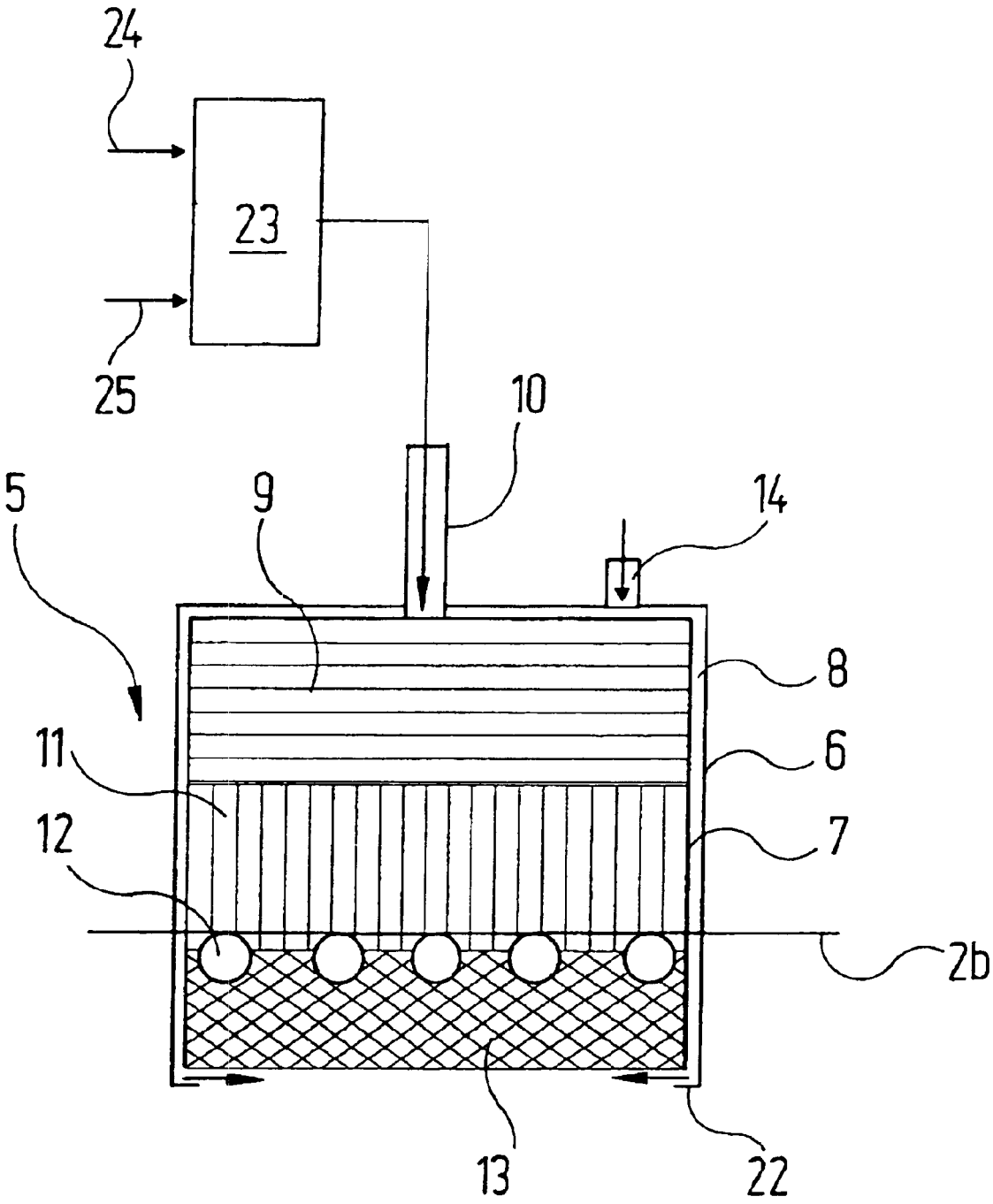
FIG. 3: shows the catalytic radiator according to FIG. 2 in combination with a premixer, which can be optionally used in the case of the drier represented in FIG. 1.

Represented in FIG. 3 is a second manner in which the catalytic radiators 5 can be supplied with intake air. The catalytic radiator 5 according to FIG. 3 is identical to that according to FIG. 2. Instead of pure combustion gas, however, a mixture of pollutant-laden intake air and combustion gas is introduced into the interior of the catalytic radiator 5 via the gas supply line 10. This mixture is produced in a premixer 23, to which combustion gas is supplied via a first line 24 and exhaust gas containing pollutants is supplied via a second line 25.

The lines 25 of the premixers of the catalytic radiators 5 assigned to the left-hand sub-chamber 3*a* of the drying chamber 3 are connected, built into the drier 1 according to FIG. 1, in parallel to the branch lines 15*a*, 15*b*, to the line 15 via which the pollutant-laden intake air arrives from the flashing-off zone, while the lines 25 assigned to the sub-chamber 3*b*, on the right in FIG. 1, of the drying chamber 3, are connected, in parallel to the lines 18*a*, 18*b*, to the line 18 carrying air which has already been pre-purified.

The ratio in which the combustion gas 24 is mixed with air in the premixers 23 is adjusted so that a catalytic oxidation of the pollutants occurs which is as complete as possible, according to the pollutant load of the air. It is also possible to determine accordingly by experiment which proportion of the pollutant-laden air is supplied to the premixer via the line 25 and which proportion is supplied to the catalytic radiator 5 via the air supply nozzle 14.

What is claimed is:

1. Drier for objects, the drier comprising:

a) a housing, comprising a drying chamber capable of accommodating objects to be dried;

b) a connection for intake air;

c) a connection for exhaust air;

d) at least one catalytic radiator which, in turn, comprises:

da) at least one connection for combustion gas;

db) a catalytically active layer to which the combustion gas is supplied;

dc) at least one connection for combustion air, connected to the catalytically active layer via an air duct;

characterized in that e) the connection of the drier for intake air is connected exclusively to the connection of the catalytic radiator for combustion air, in such a way that, apart from unavoidable leakages of the housing, all the intake air is routed as combustion air via the catalytic radiator; and f) the catalytic radiator is of heat resistant design, such that it does not require air cooling.

2. Drier according to claim 1, characterized in that the catalytic radiator has a connection via which exclusively intake air is supplied to it.

3. Drier according to claim 1, characterized in that the catalytic radiator has a connection which is connected to a premixer in which combustion gas and intake air are mixed together.

4. Drier according to claim 1, characterized in that it comprises at least one blower by means of which air can be circulated in the drying chamber.

5. A multi-stage drier, comprising at least two drier stages as described in claim 1, including at least a respectively upstream stage and a respectively downstream stage, wherein the exhaust-air connection of the respectively upstream stage is connected to the intake-air connection of the respectively downstream stage.

6. Method for operating a drier for objects, in which a) the objects to be dried are brought into a drying chamber in the housing of the drier;

b) in the drying chamber, the objects to be dried are exposed to an infrared radiation generated by a catalytic radiator to whose catalytically active layer combustion gas and combustion air are supplied; and c) intake air is continuously supplied to, and air continuously extracted from, the drying chamber;

characterized in that d) all the intake air supplied to the drying chamber, apart from unavoidable leakages of the housing of the drier, is routed as combustion air via the catalytically active layer of the catalytic radiator; and e) a catalytic radiator is used which is of heat resistant design, such that it does not require cooling.

7. Method according to claim 6, characterized in that at least a portion of the intake air is already mixed with the combustion gas before entering the catalytic radiator.

8. Method according to claim 6, characterized in that the exhaust air extracted from a first stage of the drier is supplied as intake air to a downstream stage of the drier.

9. Method according to claim 6, characterized in that the objects to be dried are additionally heated by convection, by a circulated air flow.

10. Method according to claim 9, characterized in that the ratio of heat applied to the objects to be dried by radiation and by convective heating is variable.

* * * * *

UNITED STATES PATENT AND TRADEMARK OFFICE

CERTIFICATE OF CORRECTION

PATENT NO. : 6,889,446 B2
DATED : May 10, 2005
INVENTOR(S) : Heiko Schneider

It is certified that error appears in the above-identified patent and that said Letters Patent is hereby corrected as shown below:

Title page,
Item [73], Assignee, should read -- Eisenmann Maschinenbau KG DE (Komplementar: Eisenmann-Stiftung) --.

Signed and Sealed this

Seventh Day of February, 2006

JON W. DUDAS
*Director of the United States Patent and Trademark Office*